US008265517B2

(12) United States Patent
Miyahara et al.

(10) Patent No.: US 8,265,517 B2
(45) Date of Patent: Sep. 11, 2012

(54) IMAGE FORMING APPARATUS HAVING PHOTOSENSITIVE MEMBER PROVIDING A BELT WITH DEVELOPER AND CLEANING MEMBER FOR CLEANING THE BELT

(75) Inventors: Kensuke Miyahara, Hekinan (JP); Shougo Sato, Seto (JP); Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 528 days.

(21) Appl. No.: 12/485,977

(22) Filed: Jun. 17, 2009

(65) Prior Publication Data

US 2009/0324279 A1 Dec. 31, 2009

(30) Foreign Application Priority Data

Jun. 26, 2008 (JP) ..... 2008-167010

(51) Int. Cl.

| | |
|---|---|
| ***G03G 15/14*** | (2006.01) |
| ***G03G 15/16*** | (2006.01) |
| ***G03G 21/00*** | (2006.01) |
| ***G03G 21/10*** | (2006.01) |

(52) U.S. Cl. ..... 399/101; 399/99; 399/303

(58) Field of Classification Search ..... 399/98, 399/99, 101, 298, 303, 308

See application file for complete search history.

(56) References Cited

U.S. PATENT DOCUMENTS

| | | | | |
|---|---|---|---|---|
| 5,303,018 | A * | 4/1994 | Terada et al. | 399/299 |
| 5,822,666 | A * | 10/1998 | Haneda et al. | 399/309 |
| 6,311,031 | B1 * | 10/2001 | Hirano | 399/101 |
| 7,894,759 | B2 * | 2/2011 | Yagi | 399/352 |

FOREIGN PATENT DOCUMENTS

| | | | |
|---|---|---|---|
| JP | 07168454 | A * | 7/1995 |
| JP | 09258574 | A * | 10/1997 |
| JP | 2000-029365 | | 1/2000 |
| JP | 2003241530 | A * | 8/2003 |
| JP | 2005-234482 | A | 9/2005 |
| JP | 2006-018043 | | 1/2006 |
| JP | 2006-276449 | | 10/2006 |
| JP | 2006317644 | A * | 11/2006 |
| JP | 2007-218936 | | 8/2007 |
| JP | 2007-292789 | | 11/2007 |

OTHER PUBLICATIONS

JP Office Action dtd May 11, 2010, JP Appln. 2008-167010, English translation.

* cited by examiner

*Primary Examiner* — David Gray
*Assistant Examiner* — Fred L Braun
(74) *Attorney, Agent, or Firm* — Banner & Witcoff, Ltd.

(57) ABSTRACT

An image-forming apparatus includes an endless belt, a photosensitive member, a driving member, a recovering member, and a cleaning member. The endless belt has a surface extending in a first direction. The photosensitive member opposes the surface to provide the surface with toner. The driving member drives the belt so that the surface moves in the first direction during an image-forming period and moves in the opposite direction during a recovering period after the image-forming period. The recovering member recovers, during the image-formation period, residual toner remaining on the photosensitive member after the toner has been provided on the surface, and provides, during the recovering period, the recovered residual toner on the photosensitive member to be provided on the surface. The cleaning member opposes the surface upstream of the photosensitive member in the first direction to clean, during the recovering period, the recovered residual toner provided on the surface.

11 Claims, 11 Drawing Sheets

IMAGE FORMING APPARATUS HAVING PHOTOSENSITIVE MEMBER PROVIDING A BELT WITH DEVELOPER AND CLEANING MEMBER FOR CLEANING THE BELT

CROSS REFERENCE TO RELATED APPLICATION

This application claims priority from Japanese Patent Application No. 2008-167010 filed Jun. 26, 2008. The entire content of this priority application is incorporated herein by reference.

TECHNICAL FIELD

The present invention relates to an image-forming apparatus having a plurality of photosensitive members, and a belt displayed in confrontation with the plurality of photosensitive members.

BACKGROUND

One image-forming apparatus well known in the art is a color electrophotographic printer employing a horizontal tandem system in which photosensitive drums are juxtaposed horizontally. Systems for forming images with color electrophotographic printers include an intermediate transfer system and a direct transfer system.

A color electrophotographic printer employing an intermediate transfer system has four photosensitive drums; and a charger, exposure unit, developing unit, transfer unit, and the like disposed around each photosensitive drum. This type of printer performs image formation as follows. First, each charger applies a uniform charge to the surface of the respective photosensitive drum. Next, the exposure unit irradiates a light beam onto the surface of each photosensitive drum to form an electrostatic latent image thereon. Subsequently, each developing unit supplies toner to the surface of the respective photosensitive drum in order to develop the electrostatic latent image into a toner image. The toner image is transferred from each photosensitive drum onto an intermediate transfer belt of the transfer unit in a primary transfer. By performing the steps for each photosensitive drum, a toner image in each of the four colors is superimposed on the intermediate transfer belt, forming a composite image on the belt.

Next, the composite image is transferred onto a sheet of paper conveyed at a coordinated timing in a secondary transfer as the sheet passes between a secondary transfer roller of the transfer unit and the intermediate transfer belt.

Next, image formation will be described for a color electrophotographic printer employing a direct transfer system. With the direct transfer system, electrostatic latent images on the photosensitive drums are similarly developed with toner in each respective color, as described above. After performing the same steps for each color of toner, the toner images are sequentially transferred onto a sheet of paper carried on a conveying belt of the transfer unit at a coordinated timing as the sheet passes between each photosensitive drum and a corresponding transfer roller, thereby forming an image on the sheet of paper.

While image formation is not being performed, the color electrophotographic printer periodically tests whether the toner image formed on each photosensitive drum is superimposed at the correct position on the belt. In order to detect the superimposing positions with accuracy, these tests are performed using a sensor disposed at a position opposing a roller on which the conveying belt is mounted, that is, in a region of the belt having no slack. A toner image formed as a patch pattern on each photosensitive drum is transferred onto the intermediate transfer belt or the paper-conveying belt and is conveyed to the sensor position. The sensor optically scans the patch patterns to detect problems in color registration and the like.

The patch patterns are subsequently recovered by a belt cleaner disposed in confrontation with the belt farther downstream of the sensor and on the side of the belt opposite the photosensitive drums (see Japanese unexamined patent application publication No. 2007-292789, for example). Hence, conventional means for recovering toner from a conveying belt is disposed on the opposite side of the belt from the photosensitive drums.

Generally, after toner images are transferred from photosensitive drums onto an intermediate transfer belt or paper, a drum cleaner recovers residual toner remaining on the photosensitive drum after a transfer operation.

However, one printer structure known in the art does not provide separate photosensitive drum cleaners, but uses the belt cleaner serving to recover residual toner from the belt also as a means to recover residual toner from the photosensitive drums.

For example, Japanese unexamined patent application publication No. 2000-29365 describes a printer including retaining means that temporarily retains residual toner collected from a photosensitive drum while images are being formed on the photosensitive drum (this period is hereinafter referred to as "during an image-forming operation"), and a belt cleaner for recovering residual toner from the belt. Residual toner temporarily retained by the retaining means is subsequently transferred to the belt and collected by the belt cleaner.

SUMMARY

As described above, color electrophotographic printers employing an intermediate transfer system or a direct transfer system have a belt cleaner disposed on the opposite side of the intermediate transfer belt or the conveying belt from the four photosensitive drums. Nevertheless, it is conceivable to dispose the belt cleaner on the same side of the belt as the photosensitive drums when attempting to produce a more compact apparatus.

However, the following problems arise when attempting to incorporate this arrangement with the conventional mechanism for recovering residual toner in an intermediate transfer type or direct transfer type color electrophotographic printer.

Two arrangements are possible when disposing the belt cleaner on the same side of the belt as the photosensitive drums: an arrangement positioning the belt cleaner upstream of the photosensitive drums in the direction that the belt moves, and an arrangement in which the belt cleaner is disposed downstream of the photosensitive drums.

Disposing the belt cleaner upstream of the photosensitive drums results in time loss, as the belt must be driven almost an entire circulation before the belt cleaner can recover residual toner transferred to the belt from the retaining means.

When disposed downstream of the photosensitive drums, on the other hand, the belt cleaner is positioned upstream of the sensor. Consequently, after the sensor detects patch patterns deposited on the conveying belt, the patch patterns are conveyed past the photosensitive drums before being recovered by the belt cleaner and may contaminate the photosensitive drums in the process. Therefore, satisfactory recovery of patch patterns cannot reasonably be achieved when the belt cleaner is positioned downstream of the photosensitive drums. This problem occurs in both intermediate transfer systems and direct transfer systems.

In view of the foregoing, it is an object of the present invention to provide a compact image-forming apparatus having a belt cleaner capable of quickly recovering toner temporarily retained by retaining means.

In order to attain the above and other objects, the present invention provides an image-forming apparatus including an endless belt, a plurality of photosensitive members, a driving member, and a recovering member, and a cleaning member. The endless belt is circularly movable and has a surface extending in a first direction. The plurality of photosensitive members is opposed to the surface to provide the surface with a toner. The driving member drives the endless belt so that the surface moves in the first direction during an image-forming period and moves in a second direction opposite to the first direction during a recovering period posterior to the image-forming period. The recovering member recovers, during the image-formation period, a first residual toner remaining on the photosensitive member after the toner has been provided on the surface, and provides, during the recovering period, the recovered first residual toner on the photosensitive member to be provided on the surface. The cleaning member is opposed to the surface at an upstream of the photosensitive member in the first direction to clean, during the recovering period, the recovered first residual toner provided on the surface.

Another aspect of the present invention provides an image-forming apparatus including an endless belt, a plurality of photosensitive members, a driving member, and a recovering member, and a cleaning member. The endless belt is circularly movable to convey a recording medium and has a surface extending in a first direction. The plurality of photosensitive members is opposed to the surface to provide the recording medium conveyed by the endless belt with a toner. The driving member drives the endless belt so that the surface moves in the first direction during an image-forming period and moves in a second direction opposite to the first direction during a recovering period posterior to the image-forming period. The recovering member recovers, during the image-formation period, a first residual toner remaining on the photosensitive member after the toner has been provided on the recording medium, and provides, during the recovering period, the recovered first residual toner on the photosensitive member to be provided on the surface. The cleaning member is opposed to the surface at an upstream of the photosensitive member in the first direction to clean, during the recovering period, the recovered first residual toner provided on the surface.

BRIEF DESCRIPTION OF THE DRAWINGS

The particular features and advantages of the invention as well as other objects will become apparent from the following description taken in connection with the accompanying drawings, in which.

DETAILED DESCRIPTION (First Embodiment)

[Structure of a Color Printer]

Figure 1:
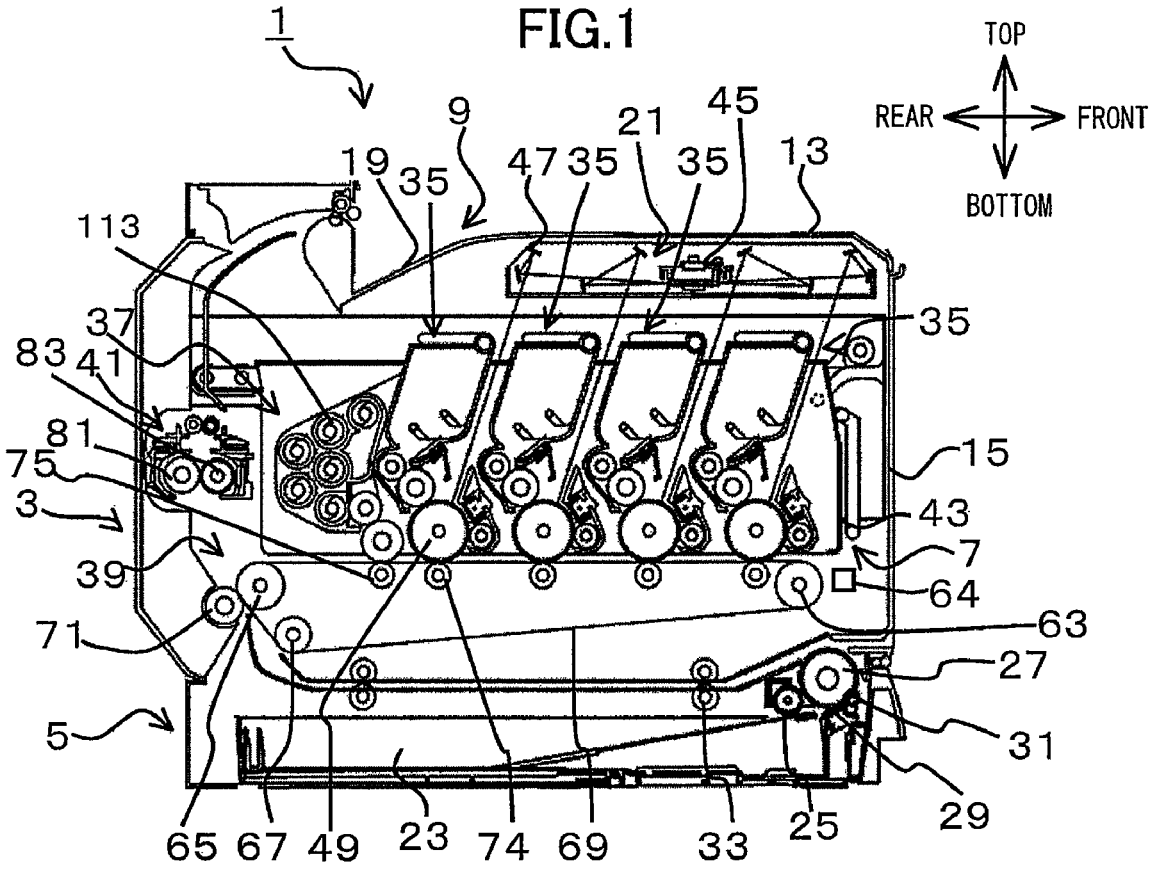
FIG. 1 is a cross-sectional view showing an overall structure of a color printer according to a first embodiment of the present invention.
Figure 2:
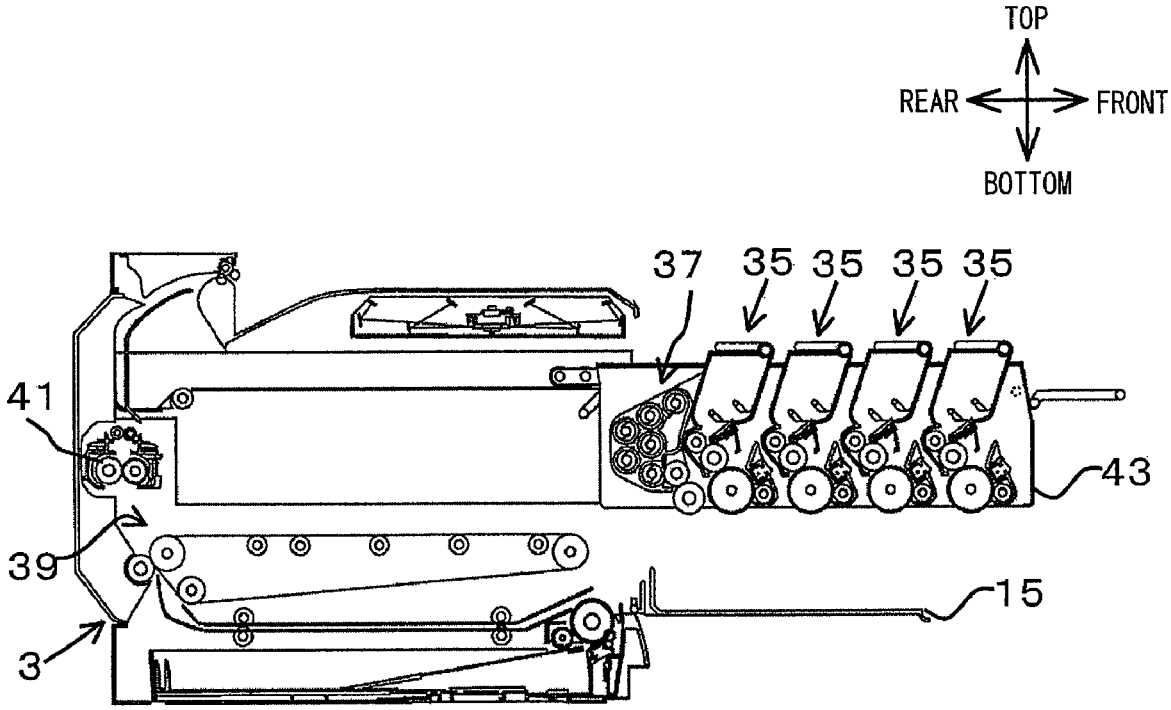
FIG. 2 is a cross-sectional view of the color printer when four process cartridges and a cleaning unit have been pulled out from a body of the color printer according to the first embodiment.
Figure 3:
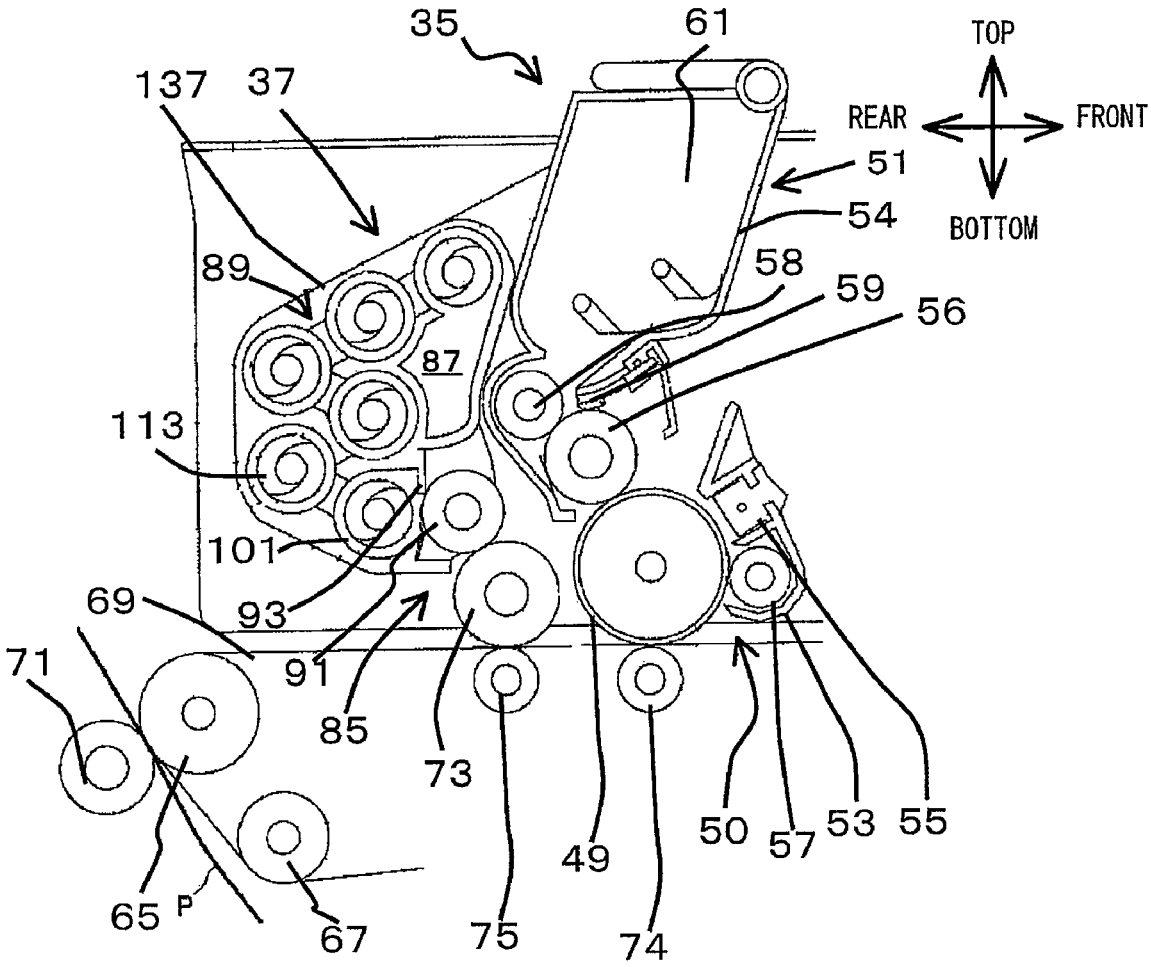
FIG. 3 is a cross-sectional view of the cleaning unit and one process cartridge according to the first embodiment.

Next, preferred embodiments of the present invention will be described while referring to the accompanying drawings. FIG. 1 is a cross-sectional view showing the overall structure of a color printer 1 as an example of the image-forming apparatus according to the present invention. FIG. 2 is a cross-sectional view of the color printer 1 when four process cartridges 35 and a cleaning unit 37 have been pulled out from the body of the color printer 1. FIG. 3 is a cross-sectional view of the cleaning unit 37 and one process cartridge 35.

The directions used in the following description are based on the perspective of the user using the color printer. Hence, in FIGS. 1 through 3, the right side in the drawing will be referred to as the "front side," the left side as the "rear side," the top and bottom as the "top" and "bottom" or "upper side" and "lower side," the far side in the drawing as the "right side," and the near side as the "left side."

As shown in FIG. 1, the color printer 1 includes a casing 3, within which are provided a feeding unit 5 for supplying sheets of a paper P for image-forming operations, an image-forming unit 7 for forming images on the paper P supplied from the feeding unit 5, and a discharge unit 9 for discharging the sheets of paper P from the color printer 1 after images have been formed thereon.

The color printer 1 also includes an upper cover 13 disposed on the top of the casing 3, a front cover 15 rotatably provided on the front of the casing 3 and capable of being rotated open and closed (forward and rearward) about hinges (not shown) provided on the lower edge of the front cover 15, and a discharge tray 19 forming the top surface of the upper cover 13 for receiving and accumulating sheets of the paper P discharged from the casing 3.

The feeding unit 5 is disposed in the bottom section of the casing 3 and primarily includes a feeding tray 23 detachably mounted in the casing 3; and a feeding roller 25, a separating roller 27, a separating pad 29 disposed above the front end of the feeding tray 23 as a paper-feeding mechanism for conveying sheets of the paper P from the feeding tray 23 to the image-forming unit 7; and a paper dust roller 31 disposed in confrontation with the separating roller 27 for removing paper dust from the sheets of paper P.

In the feeding unit 5 having this configuration, the feeding roller 25 picks up sheets of the paper P in the feeding tray 23 and feeds the sheets upward, while the separating roller 27 and separating pad 29 separate the sheets so that one sheet is fed at a time. The paper dust roller 31 removes paper dust from the sheet while the sheet passes between the paper dust roller 31 and separating roller 27, after which the sheet is guided in a direction toward the rear of the color printer 1. Conveying rollers 33 provided along the paper-conveying path supply the sheet to the image-forming unit 7.

The image-forming unit 7 is primarily configured of an exposure unit 21, four process cartridges 35, a cleaning unit 37, a transfer unit 39, and a fixing unit 41. The process cartridges 35 are disposed between the exposure unit 21 and the transfer unit 39. The four process cartridges 35 and the cleaning unit 37 are mounted in a drawer member 43 so as to be juxtaposed in the front-to-rear direction. The drawer member 43 is detachably mounted in the casing 3 and has a frame-like shape with no bottom, for example. The drawer member 43 can be pulled out of the casing 3 after opening the front cover 15 (see FIG. 2).

The exposure unit 21 is provided below the upper cover 13 and includes a laser light-emitting unit (not shown), a polygon mirror 45 driven to rotate, lenses (not shown), and reflecting mirrors 47. The laser light-emitting unit emits a laser beam for each color of toner used in the color printer 1 based on image data. The laser beams pass through or are reflected by the polygon mirror 45, the reflecting mirrors 47 corresponding to each color, and lenses corresponding to each color in sequence, and are irradiated in a high-speed scan on the surfaces of photosensitive drums 49 provided one in each process cartridge 35 for each color.

The fixing unit 41 is disposed to the rear of the process cartridges 35, transfer unit 39, and cleaning unit 37 and includes a heating roller 83, and a pressure roller 81 disposed in confrontation to the heating roller 83 and applying pressure to the same.

As shown in FIG. 3, each process cartridge 35 includes a drum cartridge 50, and a developer cartridge 51 detachably mounted on the drum cartridge 50. The drum cartridge 50 primarily includes a drum frame 53, the photosensitive drum 49 rotatably supported in the drum frame 53, a charger 55, and a retaining roller 57. Each process cartridge 35 is detachably mounted in the drawer member 43 (see FIG. 1).

An exposure opening is formed in each drum frame 53 above the respective photosensitive drum 49 between adjacent developer cartridges 51 when the developer cartridges 51 are mounted on the drum cartridges 50. Laser beams emitted from the exposure unit 21 pass through the exposure openings and are incident on the top surfaces of the photosensitive drums 49. Each retaining roller 57 is rotatably provided in the drum frame 53 so as to slide in contact with the respective photosensitive drum 49. A prescribed voltage is applied to the retaining roller 57 for temporarily recovering residual toner remaining on the photosensitive drum 49 after a transfer operation.

The developer cartridge 51 includes a developer frame 54, a developing roller 56 and a supply roller 58 rotatably supported in the developer frame 54, a thickness-regulating blade 59, and a toner-accommodating chamber 61 accommodating toner.

The sets of developer cartridges 51 and drum cartridges 50 described above all have the same structure, differing only in the color of toner accommodated in the toner-accommodating chamber 61.

As shown in FIG. 1, the transfer unit 39 is disposed between the feeding unit 5 and the process cartridges 35. The transfer unit 39 primarily includes a drive roller 65, a first follow roller 63, a second follow roller 67, an intermediate transfer belt 69, four intermediate transfer rollers 74, and a secondary transfer roller 71.

The drive roller 65 and first follow roller 63 are arranged parallel to each other and separated in the front-to-rear direction. The drive roller 65 is rotatably disposed on the upstream side of the photosensitive drums 49 relative to the direction that toner is conveyed during image formation. The second follow roller 67 is disposed diagonally below the drive roller 65.

The intermediate transfer belt 69 is an endless belt mounted over the drive roller 65, first follow roller 63, and second follow roller 67. The outer surface of the intermediate transfer belt 69 confronts and contacts each of the photosensitive drums 49. A total of four intermediate transfer rollers 74 are disposed inside the intermediate transfer belt 69 at positions confronting each of the photosensitive drums 49 respectively so as to pinch the intermediate transfer belt 69 against the photosensitive drums 49. A transfer bias is applied to the intermediate transfer rollers 74 during a transfer operation according to constant current control.

The secondary transfer roller 71 is disposed at a position confronting the drive roller 65 on the outside of the intermediate transfer belt 69. A sheet of paper P contacts the intermediate transfer belt 69 while passing between the drive roller 65 and secondary transfer roller 71. By applying a transfer bias to the secondary transfer roller 71, toner images carried on the intermediate transfer belt 69 are transferred onto the sheet of paper P.

A photosensor 64 is disposed so as to face the outside of the intermediate transfer belt 69 passing over the first follow roller 63. The photosensor 64 is provided with optical scanning means for irradiating infrared light or other light toward the intermediate transfer belt 69 and for scanning light reflected off the intermediate transfer belt 69. In order to adjust color registration, patches formed in each of the four colors are transferred onto the intermediate transfer belt 69 from each of the photosensitive drums 49, and the photosensor 64 irradiates light onto the patches to scan patches for each color.

A control unit (not shown) controls the exposure timing of the exposure unit 21 and the like based on color registration error among the patches in each color scanned by the photosensor 64.

The cleaning unit 37 is provided for recovering residual toner from the intermediate transfer belt 69. The cleaning unit 37 is disposed along the rear side of the process cartridges 35 and on the same side of the intermediate transfer belt 69 as the process cartridges 35. The cleaning unit 37 includes a cleaning roller 73 disposed on the same side of the intermediate transfer belt 69 as the photosensitive drums 49 and positioned upstream of the photosensitive drums 49 relative to the circulating direction of the intermediate transfer belt 69 during image formation described later.

As shown in FIG. 3, the cleaning unit 37 also includes a cleaning section 85 for recovering toner deposited on the intermediate transfer belt 69, a waste toner collection chamber 87 for collecting recovered toner, and a waste toner conveying section 89 for conveying toner from the cleaning section 85 to the waste toner collection chamber 87. Excluding the cleaning roller 73 described later, the cleaning unit 37 is detachably mounted in the drawer member 43.

The toner recovered by the cleaning unit 37 at this time is toner remaining on the intermediate transfer belt 69 after the secondary transfer roller 71 transfers toner images onto the paper P. The cleaning unit 37 also recovers toner deposited on the intermediate transfer belt 69 in the event of a paper jam, as well as during patch tests performed to test printing densities, color tones, and color registration error. Hereinafter, an operation performed to clean toner deposited on the intermediate transfer belt 69 during image formation will be referred to as a "cleaning operation."

The cleaning section 85 includes the cleaning roller 73, a recovery roller 91, and a blade 93.

The cleaning roller 73 is disposed in contact with the intermediate transfer belt 69 and functions to remove toner therefrom. The cleaning roller 73 is configured of a metal roller shaft covered with a roller member formed of conductive foam, such as silicone or urethane foam. The cleaning roller 73 pinches the intermediate transfer belt 69 against a backup roller 75 so as to apply constant pressure to the intermediate transfer belt 69. The cleaning roller 73 is rotatably held in side walls of the drawer member 43. The backup roller 75 confronting the cleaning roller 73 of the cleaning unit 37 is disposed inside the intermediate transfer belt 69.

The recovery roller 91 is a metal roller, for example, formed of metal or another hard material. The recovery roller 91 is rotatably disposed diagonally above and rearward of the cleaning roller 73 and contacts the same. The blade 93 is disposed diagonally above and rearward of the recovery roller 91 and in contact with the same, and functions to scrape toner off the surface of the recovery roller 91.

The waste toner conveying section 89 includes six conveying paths 101 extending in the left-to-right direction, and six augers 113 rotatably disposed within each of the conveying paths 101.

The conveying paths 101 are interconnected and in communication with an opening formed next to the recovery roller 91. The blade 93 is disposed in this opening. When the blade 93 scrapes waste toner off the recovery roller 91, the waste toner falls into the nearest conveying path 101 and is conveyed leftward by the auger 113 disposed in the nearest conveying path 101.

As mentioned above, the conveying paths 101 are in fluid communication. The auger 113 in the conveying path 101 disposed adjacent to the recovery roller 91 has a blade on the left end thereof for conveying toner accumulated at the left end of the auger 113 to the next adjacent conveying path 101. Similarly, each subsequent auger 113 has a blade on either the left or right ends for conveying toner to the next adjacent conveying path 101. Gears (not shown) are provided on the right ends of the augers 113 for rotating the augers 113 in prescribed directions.

After toner is conveyed through the conveying paths 101 to the final auger 113, the final auger 113 conveys the waste toner into the waste toner collection chamber 87.

The waste toner collection chamber 87 is a chamber for collecting recovered toner. A frame 137 forming the framework of the cleaning unit 37 is configured in a prescribed shape for defining the waste toner collection chamber 87.

[Hardware Configuration of the Color Printer]

Figure 4:
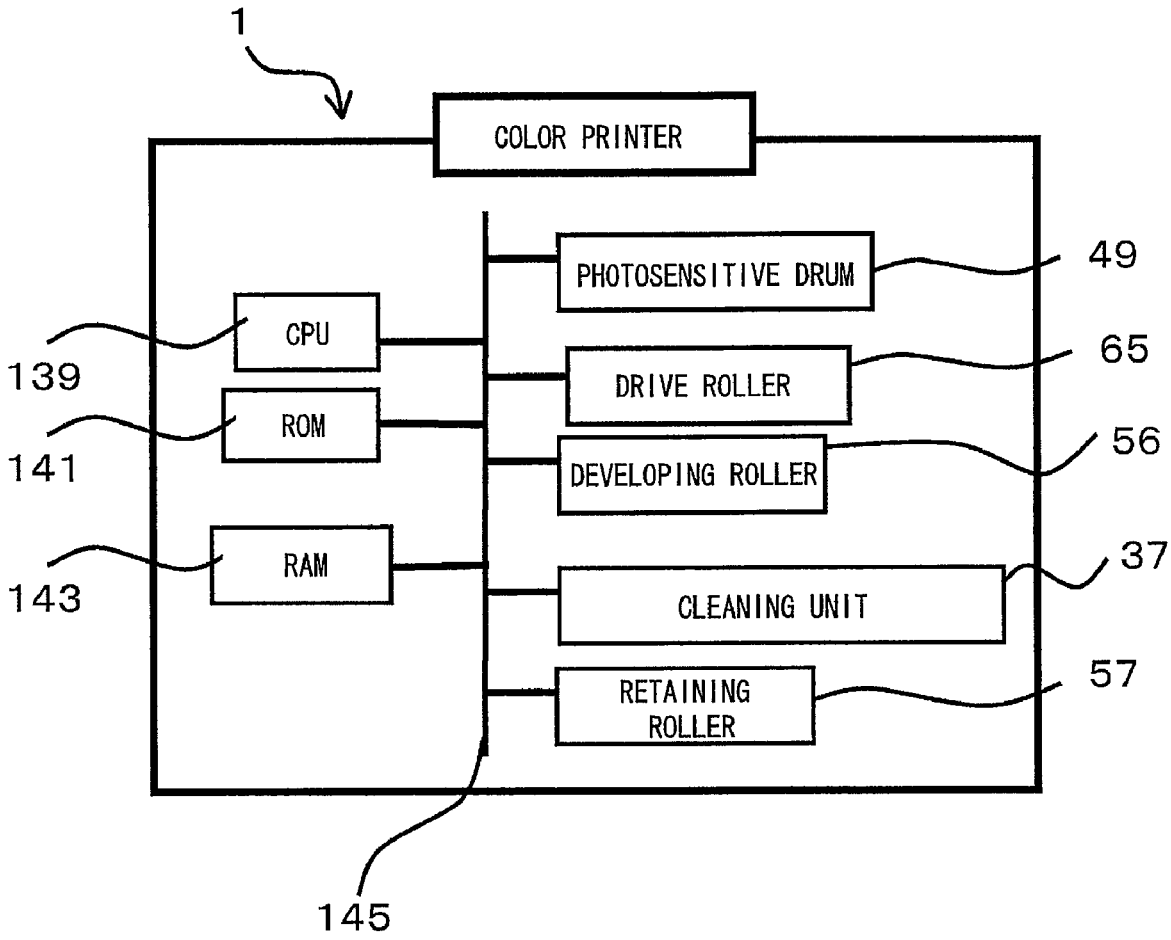
FIG. 4 is a block diagram showing a hardware configuration of the color printer according to the first embodiment.

Next, the hardware configuration of the color printer 1 will be described with reference to the block diagram in FIG. 4. As shown in FIG. 4, the color printer 1 includes a CPU 139, a ROM 141, a RAM 143, the photosensitive drums 49, the drive roller 65, the developing roller 56, the cleaning unit 37, and the retaining roller 57, all of which components are interconnected so as to be capable of inputting and outputting control signals via a bus 145.

The ROM 141 stores execution programs for controlling the operations of the color printer 1. The CPU 139 controls each component of the color printer 1 via control circuits (not shown) by issuing control signals for image formation based on the programs read from the ROM 141, while storing processing results in the RAM 143.

When the CPU 139 issues a command to begin the image-forming operation described below, the photosensitive drums 49 begin rotating counterclockwise in FIG. 1.

The drive roller 65 rotates clockwise in FIG. 1 in response to a command from the CPU 139, driving the intermediate transfer belt 69 mounted around the drive roller 65 to rotate.

The developer cartridge 51 performs the image-forming operation described below in response to a command from the CPU 139. Based on a command from the CPU 139, the cleaning unit 37 is controlled to rotate the cleaning roller 73 for recovering toner deposited on the intermediate transfer belt 69. The retaining rollers 57 are controlled to rotate in response to a command from the CPU 139 for recovering residual toner from the photosensitive drums 49.

[Image-Forming Operation]

Next, steps of an image-forming operation will be described with reference to FIGS. 1 and 3. First, the chargers 55 in the image-forming unit 7 apply a uniform positive charge (800 V in the preferred embodiment) to the surfaces of the corresponding photosensitive drums 49. Subsequently, the exposure unit 21 irradiates laser beams for each color onto the respective photosensitive drums 49 based on image data, reducing the potential (to 150 V in the preferred embodiment) in regions on the surfaces exposed to the laser beams. The regions with reduced potential form electrostatic latent images corresponding to the image data.

Each supply roller 58 is rotated to supply toner from the respective toner-accommodating chamber 61 to the developing roller 56. As the developing roller 56 rotates, the thickness-regulating blade 59 regulates the thickness of toner carried on the surface of the developing roller 56 to a uniform thin layer. At this time, the toner carried on the developing roller 56 is positively tribocharged between the supply roller 58 and developing roller 56 and between the developing roller 56 and thickness-regulating blade 59.

As the surface of the developing roller 56 rotates in contact with the photosensitive drum 49, the toner carried on the developing roller 56 is supplied to the electrostatic latent image formed on the photosensitive drum 49. At this time, the toner is selectively transferred onto the photosensitive drum 49, forming a visible toner image from the latent image through reverse development.

As the intermediate transfer belt 69 passes between each photosensitive drum 49 and the corresponding intermediate transfer roller 74, the toner images on the photosensitive drums 49 are sequentially transferred onto and superimposed over the intermediate transfer belt 69, forming a color image thereon. As the intermediate transfer belt 69 circulates, the toner images transferred onto the surface of the intermediate transfer belt 69 arrive at a position in contact with the paper P between the drive roller 65 and secondary transfer roller 71. During this process, the outer surface of the intermediate transfer belt 69 opposing the photosensitive drums 49 moves in a forward direction.

As the sheet of paper P is conveyed between the drive roller 65 and secondary transfer roller 71, the color image formed on the intermediate transfer belt 69 is transferred onto the sheet.

Subsequently, the sheet passes between the heating roller 83 and pressure 81 in the fixing unit 41, where the toner image is fixed to the sheet with heat.

As shown in FIG. 1, the discharge unit 9 includes pairs of conveying rollers disposed along a discharge-side conveying path for the paper P downstream of the fixing unit 41, and a discharge opening through which the paper P is discharged onto the discharge tray 19. Hence, after the toner images are transferred onto the sheet of paper P and fixed by heat in the fixing unit 41, the pairs of conveying rollers convey the sheet along the discharge-side conveying path and discharge the sheet from the casing 3 to be accumulated on the discharge tray 19.

As described above, residual toner deposited on the intermediate transfer belt 69 during the image-forming operation is cleaned by performing the cleaning operation described. However, residual toner deposited on the respective photosensitive drums 49 during the image-forming operation is cleaned by performing a recovery operation described below.

[Operation to Recover Residual Toner]

Figure 5:
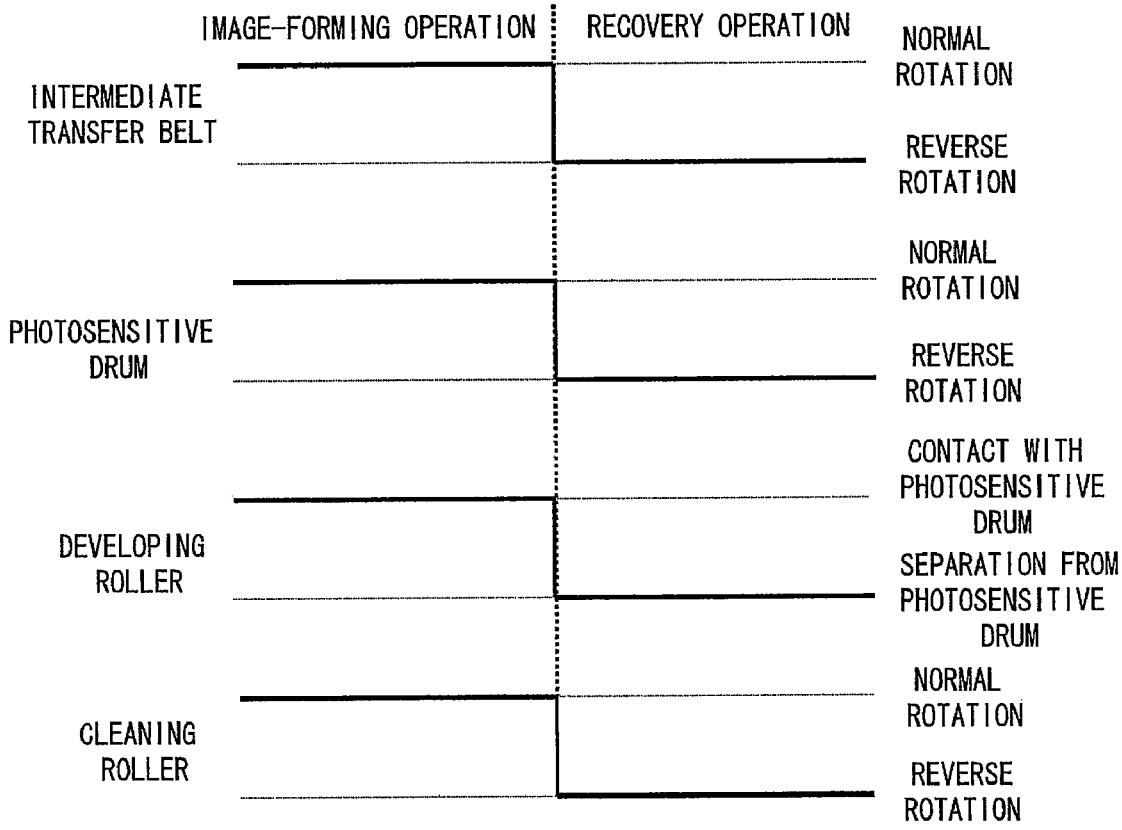
FIG. 5 is a timing chart illustrating timings of operations performed in an image-forming unit during an image-forming operation and during a recovery operation according to the first embodiment.

Next, an operation to recover residual toner will be described with reference to the drawings. In this process, the retaining rollers 57 temporarily recover and retain residual toner deposited on the respective photosensitive drums 49 during an image-forming operation, and subsequently eject the residual toner back onto the photosensitive drums 49 to be ultimately recovered by the cleaning roller 73. Hereinafter, the expression "during the recovery operation" will be used to describe the period during which steps are performed to eject residual toner retained by the retaining rollers 57 back onto the photosensitive drums 49 and to recover this residual toner with the cleaning roller 73. FIG. 5 is a timing chart illustrating the timing of operations performed in the image-forming unit 7 during the image-forming operation and during the recovery operation.

During the image-forming operation, the intermediate transfer belt 69 is driven by the rotation of the first follow roller 63 to circulate clockwise in FIG. 1. At this time, each photosensitive drum 49 and respective developing roller 56 of the developer cartridge 51 are in contact with each other for forming an image on the surface of the photosensitive drum 49. The photosensitive drum 49 rotates counterclockwise in FIG. 1 and the developing roller 56 clockwise. The cleaning roller 73 (see FIG. 3) also rotates in a clockwise direction. Further, the cleaning roller 73 is positioned on the upstream side of the four photosensitive drums 49 with respect to the circulating direction of the intermediate transfer belt 69. Hereinafter, the rotating direction used during image formation will be referred to as the "normal rotation."

The toner image formed on the surface of each photosensitive drum 49 during image formation is subsequently transferred onto the intermediate transfer belt 69. At this time, the entire toner image is sometimes not transferred onto the intermediate transfer belt 69, with some of the toner remaining on the photosensitive drum 49. This residual toner remains deposited on the photosensitive drum 49 until rotating into contact with the retaining roller 57.

At this time, a bias (−300 V in the preferred embodiment) is applied to the retaining roller 57, attracting the positively charged residual toner from the photosensitive drum 49 to the surface of the retaining roller 57. Since the photosensitive drum 49 and retaining roller 57 rotate during the image-forming operation, residual toner is carried on the photosensitive drum 49 to the retaining roller 57 and subsequently transferred onto the surface of the retaining roller 57. Therefore, almost no residual toner remains on the surface of the photosensitive drum 49 that has rotated past the retaining roller 57.

Also during the image-forming operation, some of the toner carried on the intermediate transfer belt 69 is not transferred onto the paper P by the secondary transfer roller 71 but remains deposited on the intermediate transfer belt 69. To recover this toner, a cleaning operation is performed by applying a bias between the cleaning roller 73 and the intermediate transfer belt 69 to clean the toner from the intermediate transfer belt 69.

In addition to normal printing operations, the above operation to recover residual toner may be performed to temporarily retain toner that was not transferred onto the intermediate transfer belt 69 but remains on the surface of the photosensitive drum 49 when printing test patches on the intermediate transfer belt 69 for detecting color registration error.

Figure 6:
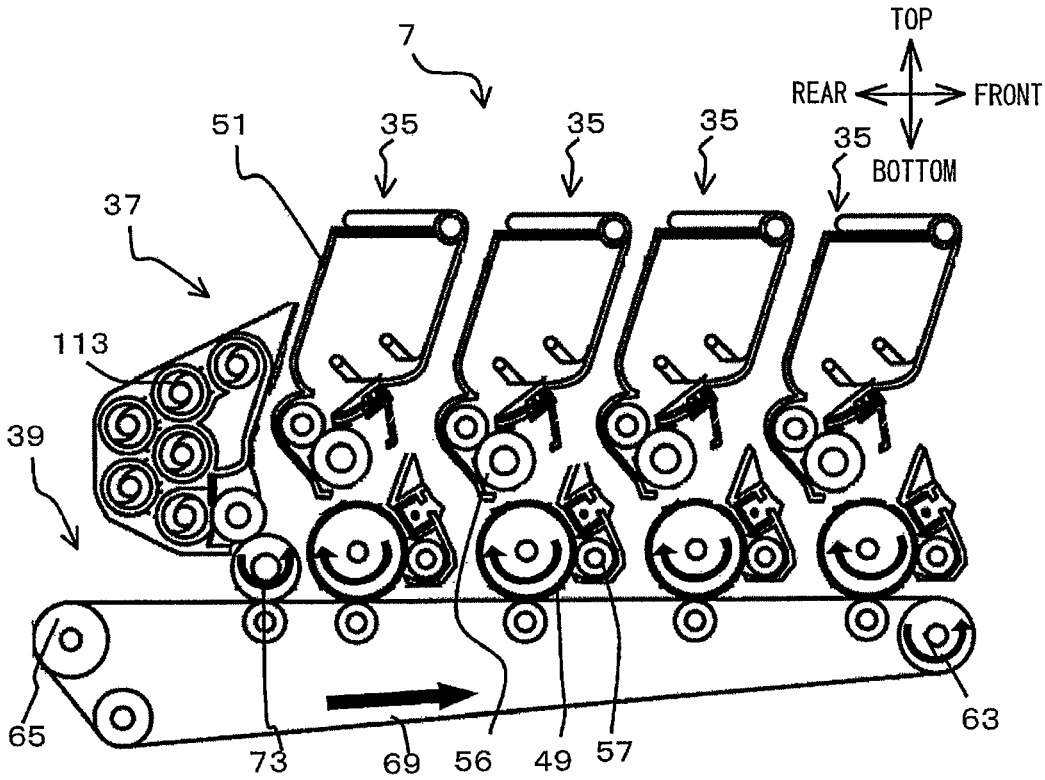
FIG. 6 is a cross-sectional view of the image-forming unit during the recovery operation according to the first embodiment.

Next, the recovery operation will be described in which the cleaning roller 73 recovers residual toner temporarily retained by the retaining rollers 57 during image formation. FIG. 6 is a cross-sectional view of the image-forming unit 7 during a recovery operation.

After completing a printing operation in which the toner images transferred onto the intermediate transfer belt 69 are subsequently transferred onto a sheet of paper P at the secondary transfer roller 71, the image-forming unit 7 is shifted into a residual toner recovery operation performed with the cleaning roller 73. The cleaning roller 73 performs the residual toner recovery operation based on control signals from the CPU 139. More specifically, the recovery operation is performed after the color printer 1 receives a print command for one page and performs an image-forming operation to form an image on a sheet of paper P. However, the residual toner recovery operation may be performed after completing an entire print job in which more than one page is printed in succession. The residual toner recovery operation may also be performed after clearing a paper jam that occurs during the image-forming operation.

When the image-forming unit 7 enters the residual toner recovery operation, the rotating directions of the four photosensitive drums 49, intermediate transfer belt 69, and cleaning roller 73 are switched to the direction (indicated by arrows in FIG. 6) opposite that during the image-forming operation. The rotation of the developing rollers 56 is halted at this time. The developing rollers 56 are also separated from the photosensitive drums 49 so as not to slide against the same (see FIG. 6). At this time, the cleaning roller 73 is positioned on the downstream side of the photosensitive drums 49 relative to the new circulating direction of the intermediate transfer belt 69. The rotating directions of components during a recovery operation will hereinafter be referred to as the "reverse rotation."

After the color printer 1 described above is shifted from the image-forming operation to the residual toner recovery operation, a bias (800 V in the preferred embodiment) is applied to each retaining roller 57 disposed in opposition to each photosensitive drum 49, causing residual toner retained on the surfaces of the retaining rollers 57 during image formation to be ejected back onto the respective photosensitive drums 49. This ejected residual toner is carried on the surfaces of the rotating photosensitive drums 49 to a position opposing the intermediate transfer belt 69.

At this time, a bias (−2000 V in the preferred embodiment) is applied to the intermediate transfer belt 69 for attracting the residual toner thereto. By applying a bias (−1500 V in the preferred embodiment) to the cleaning roller 73, residual toner carried on the intermediate transfer belt 69 is recovered by the cleaning roller 73 and stored in the cleaning unit 37.

Since the photosensitive drums 49 rotate in reverse during a recovery operation, the residual toner ejected back onto the photosensitive drums 49 is returned to the intermediate transfer belt 69 along the same path followed during image formation. Hence, the path for carrying residual toner to the intermediate transfer belt 69 is shorter than if the photosensitive drums 49 were driven in the normal rotation.

Further, since the intermediate transfer belt 69 circulates in reverse during the recovery operation, the cleaning roller 73 now exists downstream of the photosensitive drums 49 in the circulating direction of the intermediate transfer belt 69, thereby minimizing the distance that residual toner is conveyed to the cleaning roller 73 after being transferred to the intermediate transfer belt 69 from the photosensitive drums 49. If the intermediate transfer belt 69 were left to circulate in the normal rotation during the recovery operation, the cleaning roller 73 would be positioned on the upstream side of the photosensitive drums 49 relative to the circulating direction of the intermediate transfer belt 69, making it necessary to drive the intermediate transfer belt 69 in almost a complete circulation in order to recover all residual toner.

Hence, by driving the intermediate transfer belt 69 in the reverse rotation during the recovery operation, it is possible to shorten the recovery time. Further, since the photosensitive drums 49 also move in the reverse rotation at this time, the surfaces of the photosensitive drums 49 and the intermediate transfer belt 69 at their points of contact move in the same direction, preventing damage or wear to the surfaces of these components due to the surfaces rubbing against each other.

Further, by driving the cleaning roller 73 in reverse rotation during the recovery operation, the cleaning roller 73 rotates so as to slide against the moving surface of the intermediate transfer belt 69. Therefore, the cleaning roller 73 can clean and recover residual toner from the intermediate transfer belt 69 under the same conditions whether during an image-forming operation or a recovery operation.

In the intermediate transfer type color printer described above, residual toner temporarily retained by retaining rollers during image formation is recovered by the cleaning unit via the intermediate transfer belt 69 in a recovery operation. At this time, the circulating direction of the intermediate transfer belt during the recovery operation is reversed from that during the image-forming operation so that residual toner can be carried to the cleaning unit along the shortest path.

(Second Embodiment)

[Structure of a Direct Transfer Type Laser Printer and an Image-Forming Operation Performed Thereon]

In the intermediate transfer type color printer described in the first embodiment, it is possible to shorten the recovery time for residual toner by driving the intermediate transfer belt in opposite directions during the image-forming operation and the recovery operation. Next, a second embodiment will be described while referring to the accompanying drawings, wherein the present invention is applied to a direct transfer type laser printer 201 that directly transfers toner images formed on the surfaces of photosensitive drums to the paper P.

Figure 7:
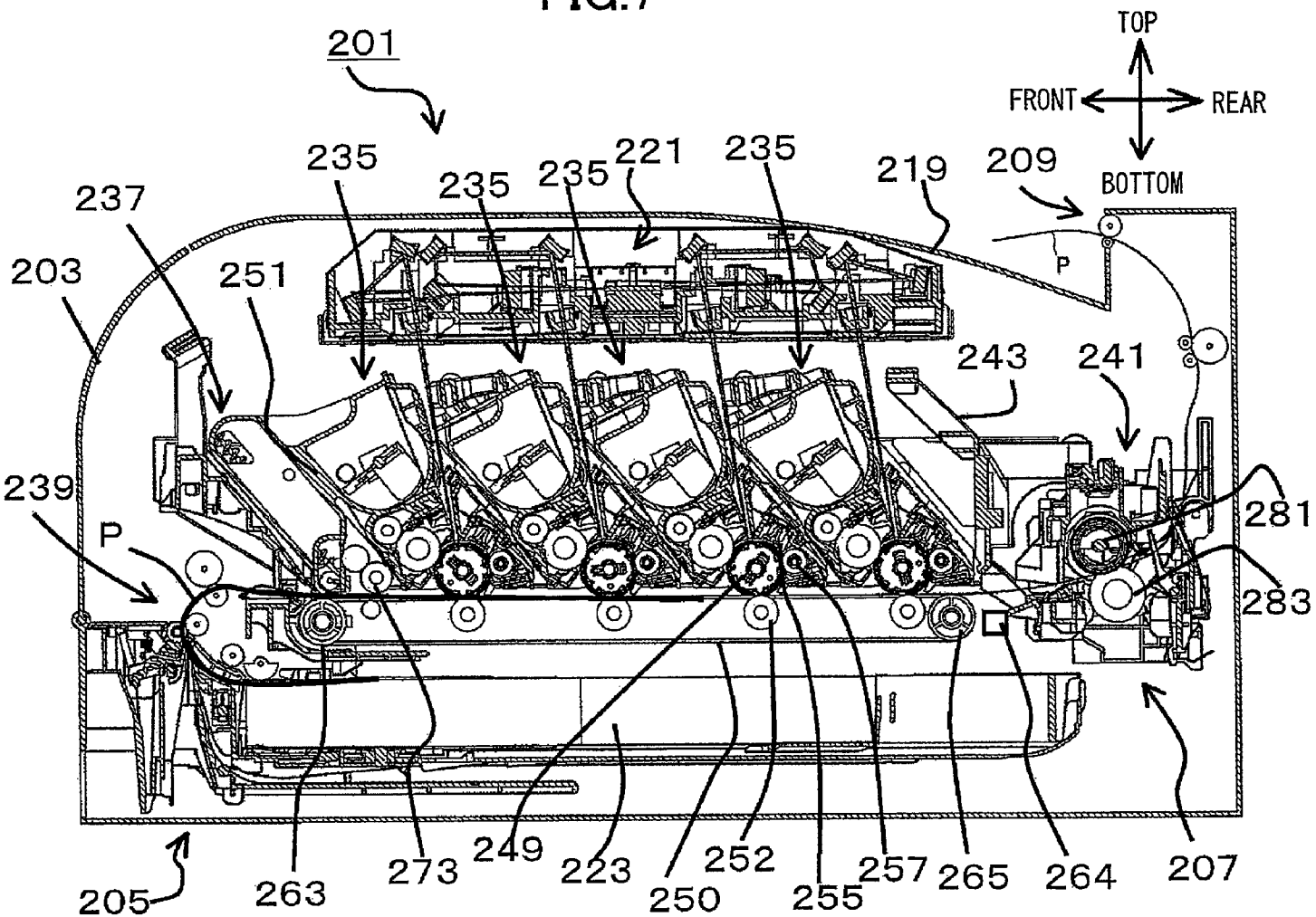
FIG. 7 is a cross-sectional view of a direct transfer type laser printer according to a second embodiment of the present invention.
Figure 8:
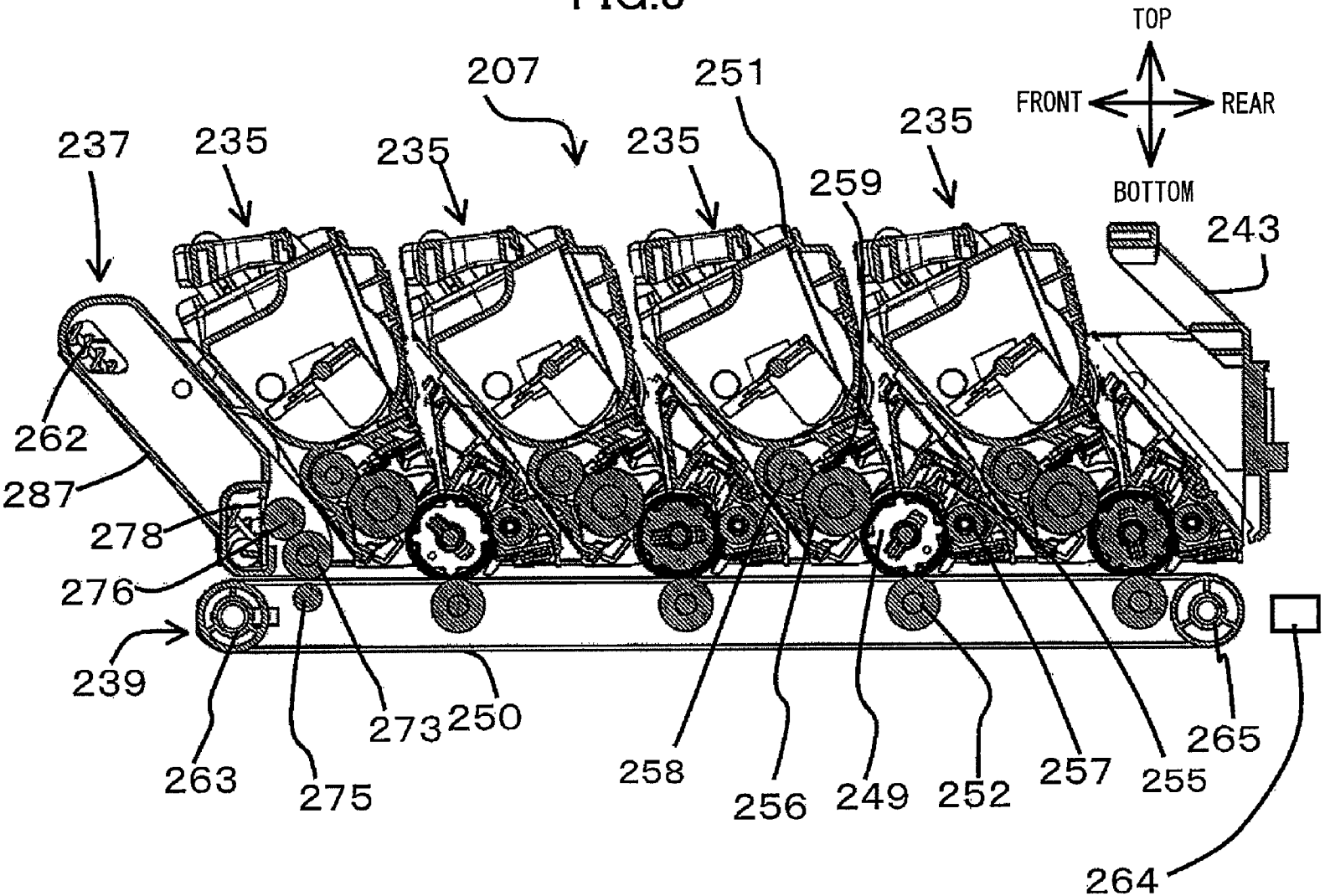
FIG. 8 is a cross-sectional view showing an image-forming unit of the laser printer during an image-forming process according to the second embodiment.

First, the structure of the laser printer 201 will be described. FIG. 7 is a cross-sectional view of the direct transfer type laser printer 201. FIG. 8 is a cross-sectional view showing an image-forming unit 207 of the laser printer 201 during an image-forming process. Note that a fixing unit 241 and an exposure unit 221 are not shown in FIG. 8.

As with the color printer 1 according to the first embodiment, the direct transfer type laser printer 201 shown in FIG. 7 includes a casing 203, within which are provided a feeding unit 205 supplying sheets of a paper P for image-forming operations, an image-forming unit 207 for forming images on the paper P supplied from the feeding unit 205, and a discharge unit 209 for discharging the sheets of paper P from the laser printer 201 after images have been formed thereon.

As shown in FIG. 8, as with the intermediate transfer type color printer 1 described in the first embodiment, the image-forming unit 207 is primarily configured of an exposure unit 221 (see FIG. 7), four process cartridges 235, a cleaning unit 237, a transfer unit 239, and a fixing unit 241 (see FIG. 7). The process cartridges 235 and the cleaning unit 237 are integrally mounted in a drawer member 243. The process cartridges 235 and cleaning unit 237 can be removed together from the image-forming unit 207 by pulling the drawer member 243 forward after opening a front cover (not shown).

The transfer unit 239 is disposed between the feeding unit 205 and the process cartridges 235 and is primarily configured of a drive roller 265, a follow roller 263, a conveying belt 250, and transfer rollers 252.

The drive roller 265 and follow roller 263 are arranged parallel to each other and separated in the front-to-rear direction. The drive roller 265 is disposed downstream of the follow roller 263 in the direction that toner images are conveyed during image formation and is driven to rotate clockwise in FIG. 8. With this configuration, the surface of the conveying belt 250 on which toner is transferred can be stretched in a taut state.

The conveying belt 250 mounted over the drive roller 265 and follow roller 263 is configured of an endless belt stretched taut, with the outer surface of the top portion opposing photosensitive drums 249. Four of the transfer rollers 252 are disposed inside the conveying belt 250 at positions confronting the photosensitive drums 249 and pinch the conveying belt 250 against the respective photosensitive drums 249. A transfer bias is applied to the transfer rollers 252 during a transfer operation according to constant current control.

A backup roller 275 is also disposed inside the conveying belt 250 on the upstream side of the transfer rollers 252 relative to the direction that the conveying belt 250 conveys toner images. The backup roller 275 confronts a cleaning roller 273 of the cleaning unit 237 disposed on the opposite side of the conveying belt 250.

The cleaning unit 237 is disposed horizontally adjacent to the process cartridges 235 on the front side thereof and functions to remove toner deposited on the conveying belt 250. The cleaning unit 237 includes a waste toner box 287, the cleaning roller 273, a recovery roller 276, a blade 278, and an auger 262.

The cleaning roller 273 is placed in contact with the conveying belt 250 and functions to remove toner therefrom. The cleaning roller 273 is configured of a metal roller shaft covered with a roller member formed of conductive foam, such as silicone or urethane foam. The cleaning roller 273 is disposed in contact with the conveying belt 250 at a position forward of the photosensitive drums 249 and on the same side of the conveying belt 250 as the photosensitive drums 249. In other words, the cleaning roller 273 is disposed upstream of the photosensitive drums 249 with respect to the circulating direction of the conveying belt 250 during image formation.

The recovery roller 276 is a metal roller, for example, formed of metal or another hard material. The recovery roller 276 is rotatably disposed in contact with the cleaning roller 273 at a position diagonally above and forward of the cleaning roller 273. The blade 278 is disposed in front of the recovery roller 276 and contacts the recovery roller 276 to scrape toner off the surface thereof. The auger 262 functions to convey toner that the blade 278 scrapes off the recovery roller 276 toward the top of the waste toner box 287.

The waste toner box 287 has a substantially rectangular shape with parallel sides in a cross-sectional view. The cleaning roller 273 is disposed in the lower end of the waste toner box 287.

A photosensor 264 is disposed to confront the outer surface of the conveying belt 250 at a position corresponding to the drive roller 265. The photosensor 264 has optical scanning means for irradiating infrared light or other light onto the conveying belt 250 and for scanning light reflected therefrom. In order to adjust color registration, patches formed in each of the four colors are transferred onto the conveying belt 250 from each of the photosensitive drums 249, and the photosensor 264 irradiates light onto the patches to scan patches for each color.

A control unit (not shown) controls the exposure timing of the exposure unit 221 and the like based on color registration error between the patches of each color scanned by the photosensor 264.

Since the structures of the exposure unit 221, fixing unit 241, and the like are substantially the same as described in the first embodiment and the hardware configuration of the direct transfer laser printer 201 is substantially the same as that described in FIG. 4, other than the differences described above, a description of these structures has been omitted.

Next, the operations of the laser printer 201 during image formation will be described. First, chargers 255 apply a uniform positive charge to the surfaces of the photosensitive drums 249. Subsequently, the exposure unit 221 irradiates a laser beam corresponding to each color onto the surface of the corresponding photosensitive drum 249, reducing the potential in areas on the surfaces of the photosensitive drums 249 exposed to the laser beams. The areas with reduced potential form an electrostatic latent image based on image data.

Toner carried on the surface of a developing roller 256 is positively tribocharged between a supply roller 258 and the developing roller 256 and between the developing roller 256 and a thickness-regulating blade 259.

As the surface of the developing roller 256 rotates in contact with the photosensitive drum 249, the toner carried on the developing roller 256 is supplied to the electrostatic latent image formed on the photosensitive drum 249. Consequently, the toner is selectively attracted to the photosensitive drum 249, forming a visible toner image from the latent image through reverse development.

As a sheet of paper P conveyed on top of the conveying belt 250 passes between the photosensitive drums 249 and the corresponding transfer rollers 252 disposed inside the conveying belt 250, the toner images formed on the photosensitive drums 249 are transferred onto the paper P. Next, the toner images are fixed to the paper P with heat as the sheet passes between a heating roller 281 and a pressure roller 283.

After the toner images have been transferred onto and fixed to the sheet of paper P, conveying rollers convey the sheet along a discharge-side conveying path and discharge the sheet from the casing 203 to be accumulated on a discharge tray 219.

[Operation for Recovering Residual Toner in the Direct Transfer Type Laser Printer]

Figure 9:
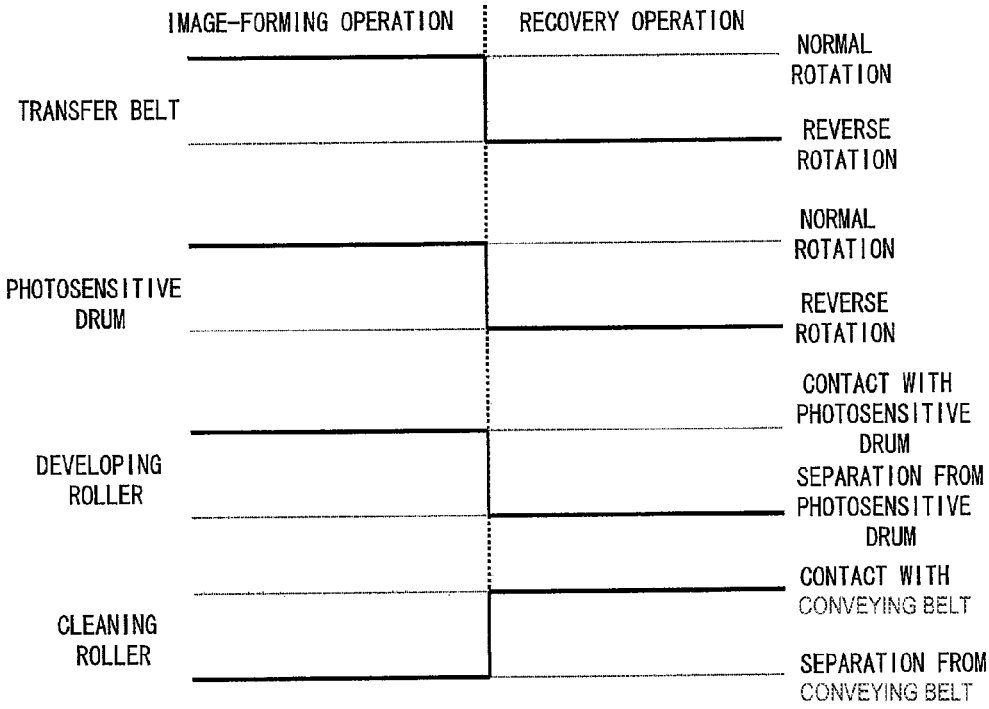
FIG. 9 is a timing chart illustrating timings of operations performed in an image-forming unit during an image-forming operation and during a recovery operation according to the second embodiment.
Figure 10:
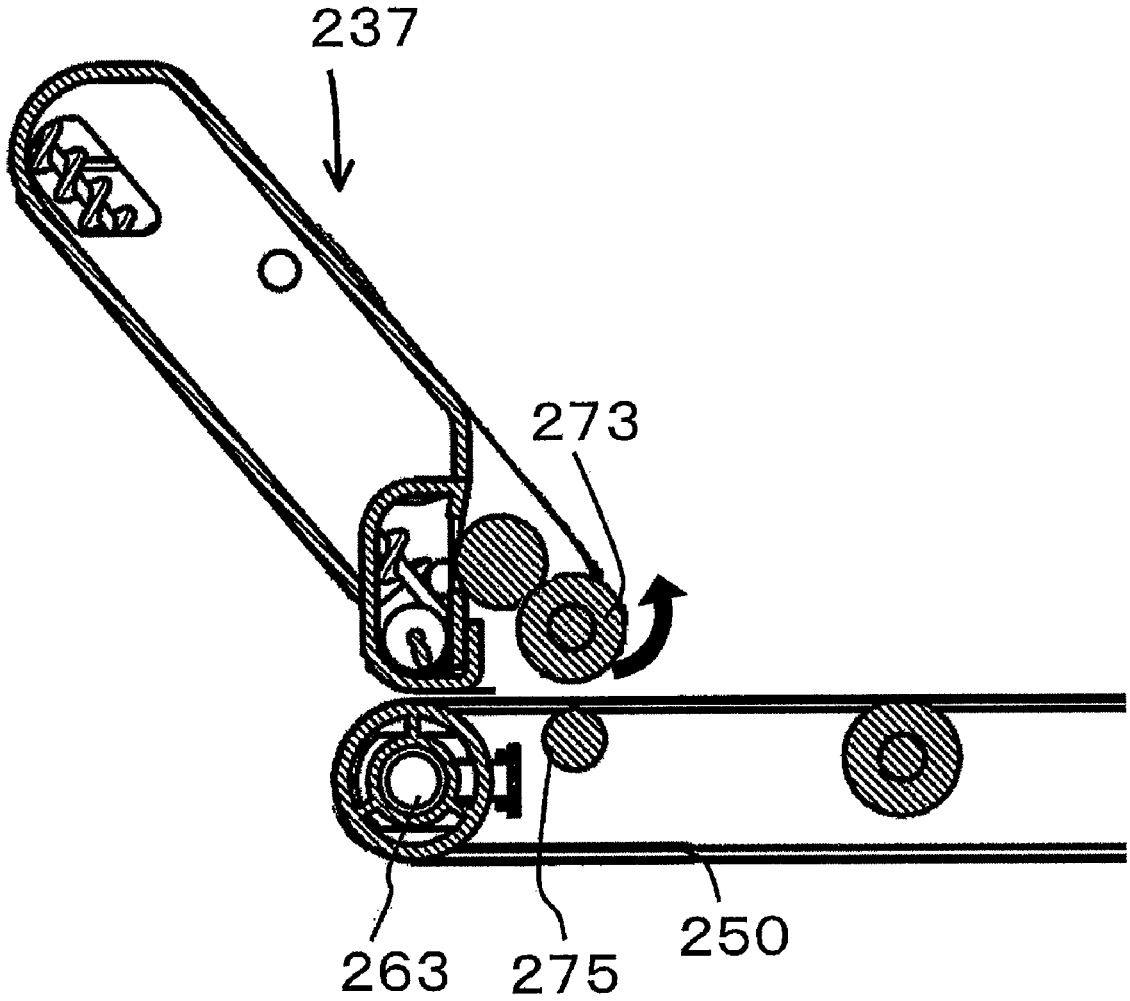
FIG. 10 is a cross-sectional view of a cleaning unit and a conveying belt according to the second embodiment.

Next, a recovery operation in the laser printer 201 having the above structure will be described while referring to the accompanying drawings. In this recovery operation, retaining rollers 257 temporarily retain residual toner deposited on the photosensitive drums 249 during image formation, and subsequently eject the residual toner back onto the photosensitive drums 249 to be ultimately recovered by the cleaning roller 273. Hereinafter, the expression "during the recovery operation" will be used to describe the period during which steps are performed to eject residual toner retained by the retaining rollers 257 back onto the photosensitive drums 249 and to recover this residual toner with the cleaning roller 273. FIG. 9 is a timing chart illustrating the timing of operations performed in the image-forming unit 207 during the image-forming operation and during the recovery operation. FIG. 10 is a cross-sectional view of the cleaning unit 237 and the conveying belt 250.

As shown in FIG. 9, the conveying belt 250 is driven by the rotation of the drive roller 265 to circulate in a clockwise direction (normal rotation) during an image-forming operation. At this time, the photosensitive drums 249 and the developing rollers 256 are in contact for forming images on the surfaces of the photosensitive drums 249. The photosensitive drums 249 rotate counterclockwise in FIG. 8, while the developing rollers 256 rotate clockwise. The cleaning roller 273 is positioned upstream of the photosensitive drums 249 relative to the circulating direction of the conveying belt 250.

Further, in order to convey the sheets of paper P on the conveying belt 250 during image formation without interference, the cleaning roller 273 of the cleaning unit 237 is raised upward, as indicated by the arrow in FIG. 10, and is halted at a position separated from the conveying belt 250.

The mechanism for separating the cleaning roller 273 from the conveying belt 250 is implemented by a rotating member (not shown) disposed on a shaft part of the cleaning roller 273 and an actuator (not shown) coupled to the rotating member. The rotating member is directed to rotate in the direction of the arrow in FIG. 10 by transmitting a signal to the actuator. Hence, the cleaning roller 273 can be separated from the conveying belt 250 via the shaft part coupled to the rotating member. However, it should be apparent that the method of separating the cleaning roller 273 from the conveying belt 250 may be implemented by another technique known in the art.

In an image-forming operation, toner images formed on the surfaces of the photosensitive drums 249 are transferred onto a sheet of paper P fed from the feeding unit 205 as the sheet is conveyed between the conveying belt 250 and each photosensitive drum 249. At this time, the entire toner image is sometimes not transferred onto the sheet of paper, with some of the toner remaining on the photosensitive drum 249. This residual toner remains deposited on the rotating photosensitive drum 249 until contacting the retaining roller 257.

At this time, a bias (−300 V in the preferred embodiment) is applied to the retaining roller 257 to attract the positively charged residual toner from the photosensitive drum 249 to the surface of the retaining roller 257. Since the photosensitive drum 249 and retaining roller 257 rotate during image formation, the residual toner is carried on the photosensitive drum 249 to the retaining roller 257 and subsequently transferred onto the surface of the retaining roller 257.

Hence, through the operations described above, toner not transferred from the photosensitive drum 249 of each color onto the paper P during image formation can be retained by the corresponding retaining roller 257.

Next, the operation for recovering residual toner retained by the retaining rollers 257 during image formation will be described with reference to FIGS. 9 and 10. Here, the timing at which an operation is performed with the cleaning roller 273 of the second embodiment to recover residual toner retained by the retaining rollers 257 is identical to the timing at which an operation was performed with the cleaning roller 73 described in the first embodiment for recovering residual toner retained by the retaining rollers 57.

As shown in FIG. 9, at the beginning of the operation to recover residual toner with the cleaning roller 273, the photosensitive drums 249 and the conveying belt 250 are switched to a reverse rotation, that is, a rotational direction opposite that in the image-forming operation. In addition, the rotation of the developing rollers 256 is halted, and the developing rollers 256 are separated from the photosensitive drums 249. At this time, the cleaning roller 273 is positioned downstream of the photosensitive drum 249 relative to the new circulating direction of the conveying belt 250.

Further, the cleaning roller 273, which was separated from the conveying belt 250, now rotates while contacting the conveying belt 250 with pressure during the recovery operation. The cleaning roller 273 rotates counterclockwise in FIG. 10.

Through the above operations, the laser printer 201 shifts from an image-forming operation to a recovery operation for recovering residual toner with the cleaning roller 273. In the recovery operation, first a bias (800 V in the preferred embodiment) is applied to the retaining rollers 257 disposed in confrontation with the respective photosensitive drums 249, causing residual toner retained on the surfaces of the retaining rollers 257 during image formation to be ejected back onto the photosensitive drums 249. The photosensitive drums 249 then convey the residual toner to a position opposing the surface of the conveying belt 250.

At this time, a bias (−2000 V in the preferred embodiment) is applied to the conveying belt 250 in order to transfer the residual toner from the photosensitive drums 249 to the conveying belt 250. Once the residual toner is transferred to the conveying belt 250, the circulating conveying belt 250 conveys the residual toner to the cleaning roller 273.

By applying a bias (−1500 V in the preferred embodiment) to the cleaning roller 273, residual toner carried on the conveying belt 250 is recovered by the cleaning roller 273 and stored in the cleaning unit 237.

Since the photosensitive drums 249 are driven in reverse rotation during the recovery operation, residual toner ejected back onto the photosensitive drums 249 is returned to the conveying belt 250 along the same path followed during image formation. Hence, the path for carrying residual toner to the conveying belt 250 is shorter than if the photosensitive drums 249 were driven in the normal rotation.

Further, since the conveying belt 250 circulates in reverse during the recovery operation, the distance for conveying residual toner to the cleaning roller 273 after being transferred to the conveying belt 250 from the photosensitive drums 249 can be minimized. If the conveying belt 250 were left to circulate in the normal rotation during the recovery operation, it would be necessary to drive the conveying belt 250 in almost a complete circulation in order to recover all residual toner.

Hence, by driving the conveying belt 250 in reverse rotation during the recovery operation, it is possible to shorten the recovery time for recovering residual toner.

Further, since the photosensitive drums 249 are also driven in reverse rotation during the recovery operation, the surfaces of the photosensitive drums 249 and the conveying belt 250 at their points of contact move in the same direction, preventing damage or wear to the surfaces of these components due to the surfaces rubbing against each other.

In the direct transfer type laser printer described above, residual toner temporarily retained by retaining rollers during image formation is recovered by the cleaning unit via the conveying belt in a recovery operation. At this time, the circulating direction of the conveying belt during the recovery operation is reversed from that during the image-forming operation so that residual toner can be carried to the cleaning unit along the shortest path, thus reducing recovery time.

[Variations of the Embodiments]

Although the present invention has been described with respect to specific embodiments, it will be appreciated by one skilled in the art that a variety of changes may be made without departing from the scope of the invention.

Figure 11:
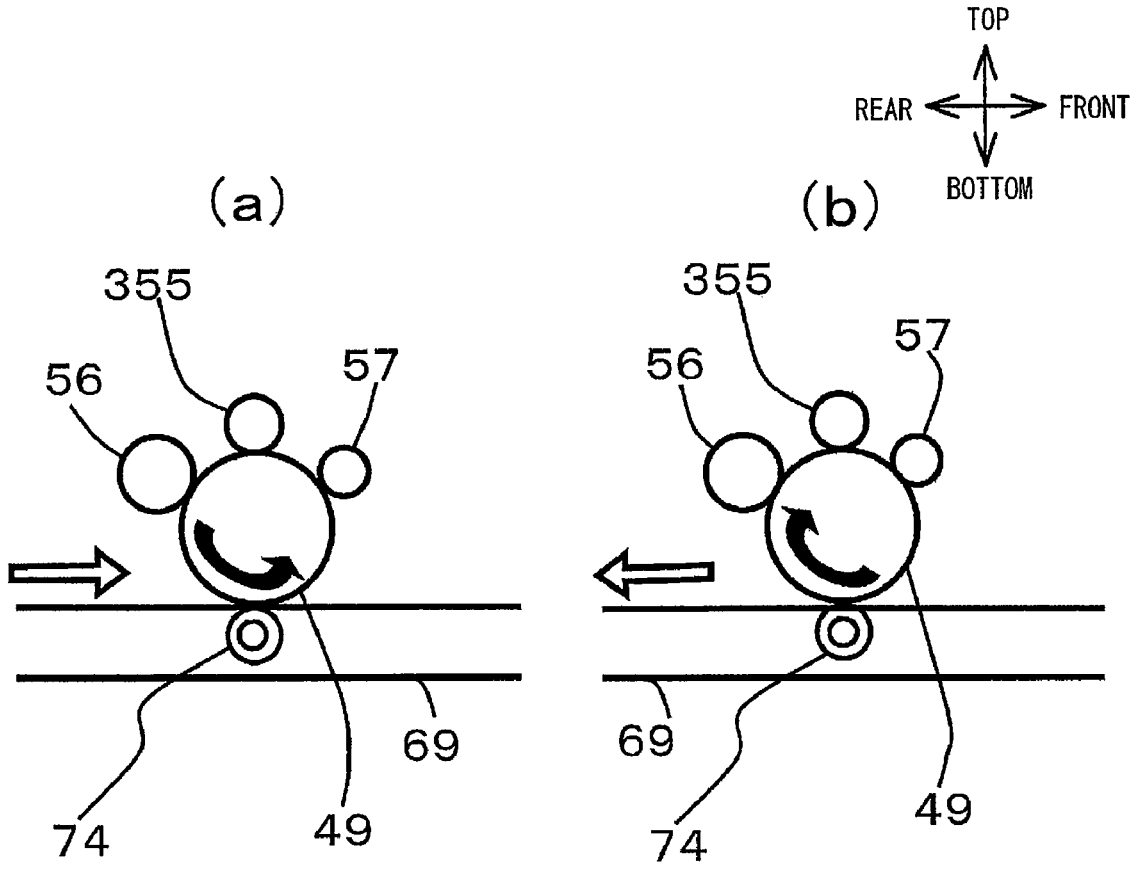
FIG. 11 is a conceptual diagram illustrating a structure of a color printer according to a variation of the embodiment around a photosensitive drum during an image-forming operation and during a recovery operation.

FIG. 11(*a*) conceptually illustrates the structure of the color printer 1 around the photosensitive drum 49 during an image-forming operation, and FIG. 11(*b*) shows the same structure during a recovery operation. In the variation of the embodiment shown in FIG. 11, a charging roller 355 is provided in place of the charger 55 in FIG. 1. Other components are designated with the same reference numerals to avoid duplicating description.

As shown in FIG. 11(*a*), the photosensitive drum 49 rotates in the direction indicated by the arrow during an image-forming operation. The developing roller 56, retaining roller 57, and charging roller 355 are disposed in contact with the photosensitive drum 49. The charging roller 355 is configured of a conductive rubber roller and functions as a charging device. The charging roller 355 contacts the photosensitive drum 49 at a position downstream of the retaining roller 57 and upstream of the developing roller 56 relative to the rotating direction of the photosensitive drum 49 during image formation. The process cartridge 35 rotates while contacting the photosensitive drum 49 with pressure and applies a bias (800 V in the preferred embodiment) for uniformly charging the surface of the photosensitive drum 49.

With this construction, the intermediate transfer roller 74, retaining roller 57, and charging roller 355 rotate clockwise during image formation. After the charging roller 355 uniformly charges the surface of the photosensitive drum 49, the polygon mirror 45 forms an electrostatic latent image on the surface of the photosensitive drum 49. When toner carried on the surface of the developing roller 56 opposes and contacts the photosensitive drum 49, the toner is supplied to the electrostatic latent image formed on the photosensitive drum 49.

Through this operation, toner is selectively transferred onto the photosensitive drum 49, forming a visible toner image from the latent image through reverse development. The toner image is transferred from the photosensitive drum 49 to the intermediate transfer belt 69 and subsequently transferred onto a sheet of paper P by the secondary transfer roller 71. At this time, any toner left on the photosensitive drum 49 that was not transferred onto the intermediate transfer belt 69 is recovered by the retaining roller 57.

As shown in FIG. 11(*b*), the rotating direction (indicated by the arrow) of the photosensitive drum 49 during the recovery operation is opposite that during the image-forming operation. Further, the circulating direction of the intermediate transfer belt 69 is also reversed during the recovery operation. The residual toner collected on the retaining roller 57 during image formation is ejected back onto the photosensitive drum 49 to be collected in the recovery operation.

Since the rotating direction of the photosensitive drum 49 at this time is opposite that during image formation, residual toner is not conveyed toward the charging roller 355 but is conveyed toward the intermediate transfer roller 74, thereby preventing contamination of the charging roller 355 from residual toner being deposited thereon. Moreover, the residual toner can be conveyed to the intermediate transfer roller 74 along the shortest path. As described above, the present invention may also be applied to a case using a charging roller as the charging member.

While the charging roller 355 is applied to an intermediate transfer type color printer in this example, the charging roller 355 may also be applied to a direct transfer type laser printer.

As another variation, the retaining rollers 57 may be replaced by rotatable cleaning brushes having brush-like bristles on the surfaces thereof. Further, in the first and second embodiments described above, one of the rollers supporting the intermediate transfer belt 69 and conveying belt 250 is a drive roller (the drive roller 65 in the first embodiment and the drive roller 265 in the second embodiment) and the other(s) is/are follow roller(s) (the first follow roller 63 in the first embodiment and the follow roller 263 in the second embodiment), but either (or any) roller may be set as the drive roller.

Alternatively, the drive roller may be switched when driving the belt during an image-forming operation and during a recovery operation. Switching the roller that is driven to the downstream side in the belt-conveying direction during image formation and recovery is particularly useful for keeping the surface of the belt opposite the photosensitive drums in a taut state. Accordingly, toner and the paper P can be conveyed with stability during both an image-forming operation and a recovery operation. It should also be apparent that structures may be added to this configuration for separating the developing rollers 56 from the photosensitive drums 49 and reversing rotation of the cleaning roller 73 during the recovery operation.

In the preferred embodiments described above, retaining rollers are provided for each of the four photosensitive drums, but it is not necessary to provide retaining rollers for all four drums. For example, a single retaining roller may be provided for the photosensitive drum whose latent images are developed with black toner, which is likely the toner consumed most among the four colors, so that only residual black toner is retained and later recovered with the cleaning roller. Alternatively, a retaining roller may be provided for the photosensitive drum that tends to accumulate the most residual toner.

While a roller-shaped cleaning member is used in the preferred embodiments, the cleaning member may be any device capable of handling changes in the circulating direction of the intermediate transfer belt or conveying belt, such as a blade-like cleaning member. For example, roller-shaped cleaning member such as a brush roller that is capable of rotating in different directions can handle changes in the circulating direction of the belt while always recovering residual toner under optimum cleaning conditions.

What is claimed is:

1. An image-forming apparatus comprising:

an endless belt configured to be circularly movable and having a surface extending in a first direction;

a photosensitive member opposed to the surface to provide the surface with a toner;

a driving member configured to drive the endless belt so that the surface moves in the first direction during an image-forming period and moves in a second direction opposite to the first direction during a recovering period after the image-forming period;

a recovering member that recovers, during the image-formation period, first residual toner remaining on at least one of the plurality of photosensitive members after the toner has been provided on the surface, and provides, during the recovering period, the recovered first residual toner on the at least one of the plurality of photosensitive members to be provided on the surface;

a cleaning member opposed to the surface upstream of the at least one of the plurality of photosensitive members in the first direction to clean, during the recovering period, the recovered first residual toner provided on the surface; and a plurality of developing members corresponding to the plurality of photosensitive members, respectively, each developing member contacting the corresponding photosensitive member to provide toner thereon during the image-forming period, and separated from the corresponding photosensitive member during the recovering period.

2. The image-forming apparatus according to claim 1, further comprising a casing on which the endless belt, the plurality of photosensitive members, the driving member, the recovering member, and the cleaning member are mounted, the plurality of photosensitive members and the cleaning member being configured to be integrally detachable from the casing.

3. The image-forming apparatus according to claim 1, wherein the cleaning member is a roller in contact with the surface, the cleaning member configured to rotate in a first rotational direction against the first direction during the image-forming period, and rotate in a second rotational direction opposite to the first rotational direction during the recovering period.

4. The image-forming apparatus according to claim 1, wherein each of the plurality of photosensitive members is a roller in contact with the surface, each of the plurality of photosensitive members rotating in a first rotational direction for the first direction during the image-forming period and in a second rotational direction opposite to the first rotational direction during the recovering period.

5. The image-forming apparatus according to claim 4, further comprising a charging member configured to contact and charge the plurality of photosensitive members, wherein the surface, the recovering member, the charging member, and the at least one of the plurality of developing members are opposed to the at least one of the photosensitive members in an order from the surface of the recovering member, the charging member, and the at least one of the plurality of developing members in the first rotational direction.

6. The image-forming apparatus according to claim 1, further comprising a transferring member that transfers, during the image-forming period, the toner provided on the surface to a recording medium, wherein the cleaning member cleans, during the image-forming period, second residual toner remaining on the surface after the toner has been transferred on the recording medium.

7. An image-forming apparatus comprising:

an endless belt configured to be circularly movable to convey a recording medium and having a surface extending in a first direction;

a plurality of photosensitive members opposed to the surface to provide the recording medium conveyed by the endless belt with toner;

a driving member configured to drive the endless belt so that the surface moves in the first direction during an image-forming period and moves in a second direction opposite to the first direction during a recovering period after the image-forming period;

a recovering member that recovers, during the image-formation period, first residual toner remaining on the at least one of the plurality of photosensitve members after the toner has been provided on the recording medium, and provides, during the recovering period, the recovered first residual toner on the at least one of the plurality of photosensitive members to be provided on the surface;

a cleaning member opposed to the surface upstream of the plurality of photosensitive members in the first direction to clean, during the recovering period, the recovered first residual toner provided on the surface; and a plurality of developing members corresponding to the plurality of photosensitive members, respectively, each developing member contacting the corresponding photosensitive member to provide toner thereon during the image-forming period, and separated from the corresponding photosensitive member during the recovering period.

8. The image-forming apparatus according to claim 7, further comprising a casing on which the endless belt, the plurality of photosensitive members, the driving member, the recovering member, and the cleaning member are mounted, the plurality of photosensitive members and the cleaning member being configured to be integrally detachable from the casing.

9. The image-forming apparatus according to claim 7, wherein the cleaning member is configured to be separated from the surface during the image-forming period, and contact the surface during the recovering period.

10. The image-forming apparatus according to claim 7, wherein each of the photosensitive members is a roller in contact with the surface, each of the plurality of photosensitive members configured to rotate in a first rotational direction for the first direction during the image-forming period and in a second rotational direction opposite to the first rotational direction during the recovering period.

11. The image-forming apparatus according to claim 10, further comprising a charging member configured to contact and charge the plurality of photosensitive members, wherein the surface, the recovering member, the charging member, and at least one of the plurality of developing members are opposed to the at least one of the plurality of photosensitive members in an order from the surface of the recovering member, the charging member, and the at least one of the plurality of developing members in the first rotational direction.

* * * * *